US012392106B2

(12) United States Patent
Fukuchi et al.

(10) Patent No.: US 12,392,106 B2
(45) Date of Patent: Aug. 19, 2025

(54) CONSTRUCTION MACHINE

(71) Applicant: Hitachi Construction Machinery Co., Ltd., Tokyo (JP)

(72) Inventors: Ryohei Fukuchi, Tsukuba (JP); Shota Ishida, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 24 days.

(21) Appl. No.: 18/280,718

(22) PCT Filed: Aug. 31, 2022

(86) PCT No.: PCT/JP2022/032866

§ 371 (c)(1),
(2) Date: Sep. 7, 2023

(87) PCT Pub. No.: WO2023/033080

PCT Pub. Date: Mar. 9, 2023

(65) Prior Publication Data

US 2024/0150995 A1 May 9, 2024

(30) Foreign Application Priority Data

Aug. 31, 2021 (JP) ..... 2021-141560

(51) Int. Cl.
*E02F 3/43* (2006.01)
*E02F 3/32* (2006.01)
*E02F 3/42* (2006.01)

(52) U.S. Cl.
CPC ..... *E02F 3/435* (2013.01); *E02F 3/32* (2013.01); *E02F 3/425* (2013.01)

(58) Field of Classification Search
None
See application file for complete search history.

(56) References Cited

U.S. PATENT DOCUMENTS

2011/0197576 A1* 8/2011 Wada ..... E02F 9/2235 60/413
2012/0163949 A1 6/2012 Okano et al.
(Continued)

FOREIGN PATENT DOCUMENTS

JP 2010-275818 A 12/2010
JP 2021-148154 A 9/2021
(Continued)

OTHER PUBLICATIONS

International Preliminary Report on Patentability (PCT/IB/338 & PCT/IB/373) issued in PCT Application No. PCT/JP2022/032866 dated Mar. 14, 2024, including English translation of Written Opinion (PCT/ISA/237) (6 pages).
(Continued)

*Primary Examiner* — Amelia Vorce
(74) *Attorney, Agent, or Firm* — Crowell & Moring LLP

(57) ABSTRACT

A construction machine including a solenoid valve that reduces a boom lowering pilot pressure for a second directional control valve and a controller that controls the solenoid valve is provided. The controller computes a first opening degree command value in such a manner that a communication area between a boom lowering pressure reducing valve and a pressure receiving chamber of the second directional control valve decreases in association with a bottom pressure of a boom cylinder, computes a second opening degree command value in such a manner that the communication area increases in association with increase in a boom lowering operation amount, decides a minimum opening degree command value as an opening degree command value of the solenoid valve when an elapsed time after boom raising operation is shorter than a set time and decides a minimum selected value of the first and second opening degree command values as the opening degree command value of the solenoid valve when the
(Continued)

elapsed time is equal to or longer than the set time, and outputs a command signal according to the decided opening degree command value to the solenoid valve.

3 Claims, 3 Drawing Sheets

(56) References Cited

U.S. PATENT DOCUMENTS

| | | | | |
|---|---|---|---|---|
| 2016/0333551 | A1 | 11/2016 | Joung et al. | |
| 2018/0274208 | A1* | 9/2018 | Hijikata | F15B 13/06 |
| 2020/0002914 | A1* | 1/2020 | Yoshida | E02F 3/32 |
| 2021/0285185 | A1 | 9/2021 | Shirato et al. | |
| 2021/0348366 | A1 | 11/2021 | Ogura et al. | |
| 2022/0220696 | A1* | 7/2022 | Sugiyama | E02F 9/205 |
| 2023/0113111 | A1 | 4/2023 | Hishinuma et al. | |
| 2023/0257961 | A1* | 8/2023 | Hiranuma | G01G 19/10 37/347 |
| 2024/0018750 | A1* | 1/2024 | Nishi | B60K 35/28 |
| 2024/0052595 | A1* | 2/2024 | Itsuji | E02F 9/22 |

FOREIGN PATENT DOCUMENTS

| | | | |
|---|---|---|---|
| WO | WO 2011/027791 | A1 | 3/2011 |
| WO | WO 2019/065925 | A1 | 4/2019 |
| WO | WO 2020/188920 | A1 | 9/2020 |

OTHER PUBLICATIONS

International Search Report (PCT/ISA/210) issued in PCT Application No. PCT/JP2022/032866 dated Nov. 8, 2022 with English translation (4 pages).

Japanese-language Written Opinion (PCT/ISA/237) issued in PCT Application No. PCT/JP2022/032866 dated Nov. 8, 2022 with English translation (7 pages).

* cited by examiner

CONSTRUCTION MACHINE

TECHNICAL FIELD

The present invention relates to a construction machine such as a hydraulic excavator.

BACKGROUND ART

With a construction machine such as a hydraulic excavator, besides excavation work, various kinds of work such as bumping work and leveling work are executed. The flow rate and the pressure of a pressurized fluid necessary for driving of a boom cylinder are different, depending on work. For example, at a time of boom raising operation, the meter-in flow rate to the boom cylinder is increased through causing delivered hydraulic fluids of a plurality of hydraulic pumps to merge, or the like. In contrast, when boom lowering operation is executed in the state in which a bucket is suspended in the air, the meter-in flow rate to the boom cylinder is limited to suppress energy loss. Moreover, when boom lowering operation is executed in the state in which the bucket is grounded, the meter-in flow rate to the boom cylinder is increased to enable jack-up motion.

Such control of the meter-in flow rate to the boom cylinder is executed by controlling the flow rate of supply of a pressurized fluid to the boom cylinder by a solenoid valve according to the bottom pressure of the boom cylinder, for example (Patent Document 1).

PRIOR ART DOCUMENT

Patent Document

Patent Document 1: JP-2010-275818-A

SUMMARY OF THE INVENTION

Problem to be Solved by the Invention

Regarding the boom lowering motion executed in the state in which the bucket is suspended in the air or the jack-up motion executed through lowering the boom with the bottom surface of the bucket pressed against a ground surface, the bottom pressure of the boom cylinder does not suddenly change, and therefore the meter-in flow rate can properly be controlled by the technique disclosed in Patent Document 1.

However, for example, at a time of bumping work in which the boom is repeatedly raised and lowered, control of the meter-in flow rate acts contrary to the intention of the operator due to sharp fluctuation of the bottom pressure of the boom cylinder in some cases. At a time of boom lowering in the state in which the bucket is suspended in the air, the bottom pressure of the boom cylinder becomes high, and the rod pressure of the boom cylinder becomes low, so that the meter-in flow rate is controlled to become low. On the other hand, at a time of jack-up in which the bucket is pressed against a ground surface, the bottom pressure of the boom cylinder becomes low, and the rod pressure of the boom cylinder becomes high, so that the meter-in flow rate is controlled to become high. However, at the time of bumping work in which the boom is repeatedly operated to be raised and lowered in a short period of time, there is a possibility that the meter-in flow rate corresponding to jack-up is selected also after switching from boom raising operation to boom lowering operation due to fluctuation of the bottom pressure of the boom cylinder and the state in which the meter-in flow rate is high continues. As a result, the state in which the motion speed of the boom does not correspond with the required motion speed of the boom is caused, and the operability is possibly affected.

An object of the present invention is to provide a construction machine that can cause the motion speed of a boom to correspond with the required speed and improve the operability.

Means for Solving the Problem

In order to achieve the above-described object, the present invention provides a construction machine including a machine body, a front work implement joined to the machine body, a boom cylinder that vertically drives the front work implement, a prime mover, a first hydraulic pump driven by the prime mover, a second hydraulic pump driven by the prime mover, a first directional control valve that controls a pressurized fluid that flows from the first hydraulic pump to the boom cylinder, a second directional control valve that controls a pressurized fluid that flows from the second hydraulic pump to the boom cylinder, a pilot pump that delivers a pilot fluid that drives the first directional control valve and the second directional control valve, a boom lowering pressure reducing valve that outputs a boom lowering pilot pressure that drives the first directional control valve and the second directional control valve in a boom lowering direction with use of the pilot fluid as a source pressure, a boom raising pressure reducing valve that outputs a boom raising pilot pressure that drives the first directional control valve and the second directional control valve in a boom raising direction with use of the pilot fluid as a source pressure, and a boom operation lever to operate the boom lowering pressure reducing valve and the boom raising pressure reducing valve. The construction machine includes a bottom pressure sensor that measures a bottom pressure of the boom cylinder, an operation amount sensor that measures an operation amount of the boom operation lever, a solenoid valve that is disposed on a pilot hydraulic line that couples the boom lowering pressure reducing valve and a pressure receiving chamber of the second directional control valve and reduces the boom lowering pilot pressure for the second directional control valve, and a controller that controls the solenoid valve on the basis of the bottom pressure measured by the bottom pressure sensor and the operation amount measured by the operation amount sensor. The controller is configured to compute a first opening degree command value in such a manner that a communication area between the boom lowering pressure reducing valve and the pressure receiving chamber of the second directional control valve decreases in association with increase in the bottom pressure on the basis of the bottom pressure measured by the bottom pressure sensor, compute a second opening degree command value in such a manner that the communication area increases in association with increase in a boom lowering operation amount on the basis of the boom lowering operation amount measured by the operation amount sensor, decide a minimum opening degree command value that minimizes the communication area as an opening degree command value of the solenoid valve when an elapsed time is shorter than a set time and decide a minimum selected value of the first opening degree command value and the second opening degree command value as the opening degree command value of the solenoid valve when the elapsed time is equal to or longer than the set time, on the basis of the elapsed time after boom raising operation, and output a command signal according to the decided opening degree command value to the solenoid valve.

Advantages of the Invention

According to the present invention, the motion speed of the boom can be caused to correspond with the required speed, and the operability can be improved.

MODES FOR CARRYING OUT THE INVENTION

An embodiment of the present invention will be described below with use of the drawings.

—Construction Machine—

Figure 1:
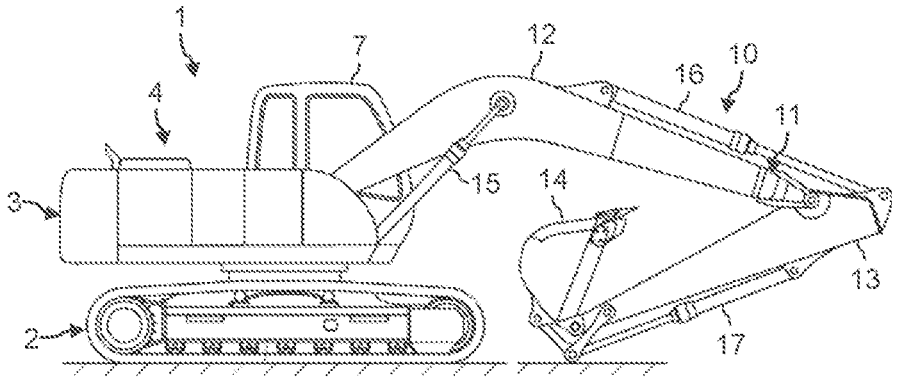
FIG. 1 is a side view representing a construction machine according to one embodiment of the present invention.

FIG. 1 is a side view representing a construction machine according to one embodiment of the present invention. In this diagram, a hydraulic excavator 1 is exemplified as the construction machine. However, the present invention can be applied to other kinds of construction machines, such as a wheel loader and a crane, which are used for various kinds of work such as civil engineering work, construction work, and demolition work. The hydraulic excavator 1 is a crawler type. However, the present invention can be applied also to a construction machine of a wheel type.

The hydraulic excavator 1 includes a machine body 4 and a front work implement 10 attached to the machine body 4. The machine body 4 includes a track structure 2 and a swing structure 3 swingably disposed on the track structure 2. The track structure 2 travels by left and right crawlers being driven by hydraulic motors for travelling. The swing structure 3 has a cab 7 in which an operator rides and is driven to swing relative to the track structure 2 by a hydraulic motor for swing disposed in the machine body 4. Inside the cab 7, the respective operation devices for operating the respective hydraulic actuators mounted in the hydraulic excavator 1, such as a boom cylinder 15 to be described later, an arm cylinder 16, and a bucket cylinder 17, besides the above-described hydraulic motors for travelling and hydraulic motor for swing are disposed.

The front work implement 10 is a work implement in which a bucket 14 that is an attachment suitable for work is mounted on a work arm 11 of an articulated type, and is joined to the swing structure 3. The work arm 11 includes a boom 12 joined to a front part of the swing structure 3 vertically pivotally and an arm 13 joined to the tip of the boom 12 pivotally in the front-rear direction. The boom 12 is driven by the boom cylinder 15. The arm 13 is driven by the arm cylinder 16. The bucket 14 is driven by the bucket cylinder 17. Although a configuration in which the bucket 14 is mounted on the work arm 11 as an attachment is exemplified in FIG. 1, the bucket 14 can be replaced by another attachment such as a grapple.

—Hydraulic System—

Figure 2:
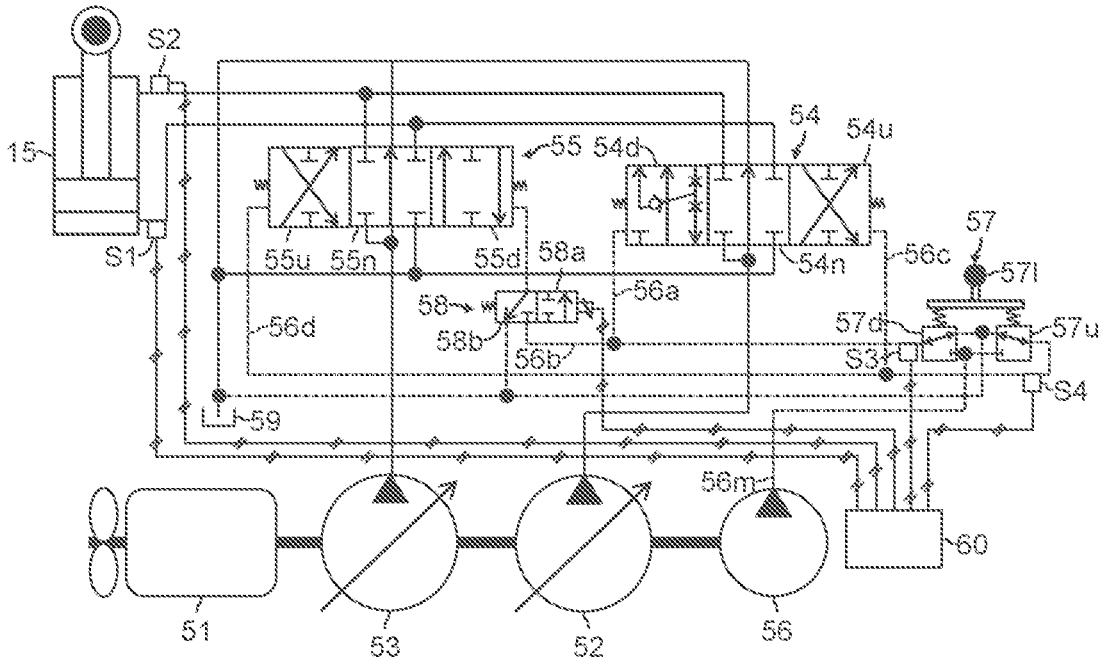
FIG. 2 is a circuit diagram representing major parts of a hydraulic system mounted in the construction machine according to the one embodiment of the present invention.

FIG. 2 is a circuit diagram representing major parts of a hydraulic system mounted in the construction machine illustrated in FIG. 1. In FIG. 2, a drive circuit of the boom cylinder 15 is extracted and represented. The hydraulic system illustrated in this diagram includes a prime mover 51, a first hydraulic pump 52, a second hydraulic pump 53, a first directional control valve 54, a second directional control valve 55, a pilot pump 56, an operation lever device 57, a solenoid valve 58, and a controller 60.

•Hydraulic Pump

The first hydraulic pump 52 and the second hydraulic pump 53 are pumps of the variable displacement type that deliver a hydraulic operating fluid that drives the hydraulic actuators mounted in the hydraulic excavator 1 and are driven by the prime mover 51. The prime mover 51 in the present embodiment is an engine that converts combustion energy to power, such as an internal combustion engine. However, an electric motor is used as the prime mover 51 in some cases. In FIG. 2, only each one pump is illustrated regarding the first hydraulic pump 52 and the second hydraulic pump 53. However, a plurality of pumps are disposed as at least one of the first hydraulic pump 52 and the second hydraulic pump 53 in some cases. A pressurized fluid that is sucked in from a hydraulic operating fluid tank 59 and is delivered from the first hydraulic pump 52 is supplied to the boom cylinder 15 via the first directional control valve 54. A pressurized fluid that is sucked in from the hydraulic operating fluid tank 59 and is delivered from the second hydraulic pump 53 is supplied to the boom cylinder 15 via the second directional control valve 55. A return hydraulic fluid from the boom cylinder 15 returns to the hydraulic operating fluid tank 59 through the first directional control valve 54 and the second directional control valve 55.

•Pilot Pump

The pilot pump 56 is a pump of the fixed displacement type that delivers a pilot fluid that drives hydraulically driven control valves such as the first directional control valve 54 and the second directional control valve 55. The pilot pump 56 is driven by the prime mover 51 as with the first hydraulic pump 52 and the second hydraulic pump 53. It is also possible to make a configuration in which the pilot pump 56 is driven by a power source different from the prime mover 51. A delivery hydraulic line **56*m* of the pilot pump 56 branches and is connected to a boom lowering pressure reducing valve 57*d* and a boom raising pressure reducing valve 57*u* of the operation lever device 57 and the like. The delivery pressure of the pilot pump 56 is input to the boom lowering pressure reducing valve 57*d*, the boom raising pressure reducing valve 57*u*, and the like through a delivery line 57*a*** as the source pressure of the pilot pressure.

•First Directional Control Valve

The first directional control valve 54 is a hydraulically driven directional control valve that controls the flow (direction and flow rate) of the pressurized fluid supplied from the first hydraulic pump 52 to the boom cylinder 15 and is driven by the pilot pressure input to a pressure receiving chamber. The first directional control valve 54 is a proportional three-position selector valve having a boom lowering position **54*d*, a boom raising position 54*u*, and a neutral position 54*n*. In the state in which the pilot pressure is not acting, the spool of the first directional control valve 54 is located at the neutral position 54*n*** due to a spring force.

When the first directional control valve 54 is at the neutral position 54*n*, the first hydraulic pump 52 bypasses the boom cylinder 15 and is connected to the hydraulic operating fluid tank 59, and the rod-side hydraulic chamber and the bottom-side hydraulic chamber of the boom cylinder 15 are closed. This causes the boom cylinder 15 to be held without elongating and contracting.

When the first directional control valve 54 is at the boom lowering position 54*d*, the first hydraulic pump 52 bypasses the boom cylinder 15 and is connected to the hydraulic operating fluid tank 59 and the bottom-side hydraulic chamber of the boom cylinder 15 is connected to the rod-side hydraulic chamber and the hydraulic operating fluid tank 59. Due to this, part of the pressurized fluid pushed out from the bottom-side hydraulic chamber due to the weight of the front work implement 10 is supplied to the rod-side hydraulic chamber, and the boom cylinder 15 contracts.

When the first directional control valve 54 is at the boom raising position 54*u*, the first hydraulic pump 52 is connected to the bottom-side hydraulic chamber of the boom cylinder 15, and the rod-side hydraulic chamber of the boom cylinder 15 is connected to the hydraulic operating fluid tank 59. This causes the boom cylinder 15 to elongate due to the pressurized fluid delivered from the first hydraulic pump 52.

•Second Directional Control Valve

The second directional control valve 55 is a hydraulically driven directional control valve that controls the flow (direction and flow rate) of the pressurized fluid supplied from the second hydraulic pump 53 to the boom cylinder 15 and is driven by the pilot pressure input to a pressure receiving chamber. The second directional control valve 55 is a proportional three-position selector valve having a boom lowering position 55*d*, a boom raising position 55*u*, and a neutral position 55*n*. In the state in which the pilot pressure is not acting, the spool of the second directional control valve 55 is located at the neutral position 55*n* due to a spring force.

When the second directional control valve 55 is at the neutral position 55*n*, the second hydraulic pump 53 bypasses the boom cylinder 15 and is connected to the hydraulic operating fluid tank 59, and the rod-side hydraulic chamber and the bottom-side hydraulic chamber of the boom cylinder 15 are closed. This causes the boom cylinder 15 to be held without elongating and contracting.

When the second directional control valve 55 is at the boom lowering position 55*d*, the second hydraulic pump 53 is connected to the rod-side hydraulic chamber of the boom cylinder 15, and the bottom-side hydraulic chamber of the boom cylinder 15 is connected to the hydraulic operating fluid tank 59. This causes the boom cylinder 15 to contract due to the pressurized fluid delivered from the second hydraulic pump 53.

When the second directional control valve 55 is at the boom raising position 55*u*, the second hydraulic pump 53 is connected to the bottom-side hydraulic chamber of the boom cylinder 15, and the rod-side hydraulic chamber of the boom cylinder 15 is connected to the hydraulic operating fluid tank 59. This causes the boom cylinder 15 to elongate due to the pressurized fluid delivered from the second hydraulic pump 53.

•Boom Lowering Pressure Reducing Valve

The pressure receiving chambers of the first directional control valve 54 and the second directional control valve 55 on the boom lowering side is connected to the boom lowering pressure reducing valve 57*d* through pilot hydraulic lines 56*a* and 56*b*, respectively, and further is connected to the pilot pump 56 through the boom lowering pressure reducing valve 57*d*. The boom lowering pressure reducing valve 57*d* is operated by a boom operation lever 57*l*. When the boom operation lever 57*l* is operated in a boom lowering direction (in FIG. 2, left direction), the boom lowering pressure reducing valve 57*d* is actuated according to an operation amount of the boom operation lever 57*l*. Due to this, the delivery hydraulic line 56*m* of the pilot pump 56 and the pilot hydraulic lines 56*a* and 56*b* are connected. In addition, a boom lowering pilot pressure according to a boom lowering operation amount of the boom operation lever 57*l* is output with the pressure of the pilot fluid from the pilot pump 56 being the source pressure. When this pilot pressure acts on the pressure receiving chambers of the first directional control valve 54 and the second directional control valve 55 on the boom lowering side, the first directional control valve 54 and the second directional control valve 55 are driven in the boom lowering direction from the neutral positions 54*n* and 55*n* and are switched to the boom lowering positions 54*d* and 55*d*.

•Boom Raising Pressure Reducing Valve

The pressure receiving chambers of the first directional control valve 54 and the second directional control valve 55 on the boom raising side is connected to the boom raising pressure reducing valve 57*u* through pilot hydraulic lines 56*c* and 56*d*, respectively, and further is connected to the pilot pump 56 through the boom raising pressure reducing valve 57*u*. The boom raising pressure reducing valve 57*u* is also operated by the boom operation lever 57*l* as with the boom lowering pressure reducing valve 57*d*. When the boom operation lever 57*l* is operated in a boom raising direction (in FIG. 2, right direction), the boom raising pressure reducing valve 57*u* is actuated according to the operation amount of the boom operation lever 57*l*. Due to this, the delivered hydraulic line 56*m* of the pilot pump 56 and the pilot hydraulic lines 56*c* and 56*d* are connected, and a boom raising pilot pressure according to a boom raising operation amount of the boom operation lever 57*l* is output with the pressure of the pilot fluid from the pilot pump 56 being the source pressure. When this pilot pressure acts on the pressure receiving chambers of the first directional control valve 54 and the second directional control valve 55 on the boom raising side, the first directional control valve 54 and the second directional control valve 55 are driven in the boom raising direction from the neutral positions 54*n* and 55*n* and are switched to the boom raising positions 54*u* and 55*u*.

•Solenoid Valve

The above-described solenoid valve 58 is a proportional solenoid pressure reducing valve that reduces the boom lowering pilot pressure output by the boom lowering pressure reducing valve 57*d* and outputs a corrected boom lowering pilot pressure (boom lowering pilot pressure that has been corrected) for the pressure receiving chamber of the second directional control valve 55 on the boom lowering side. This solenoid valve 58 is disposed on the pilot hydraulic line 56*b* that couples the boom lowering pressure reducing valve 57*d* with the pressure receiving chamber of the second directional control valve 55 on the boom lowering side. The solenoid valve 58 has an opening position 58*a* and an interruption position 58*b*. In the present embodiment, the spool of the solenoid valve 58 is pressed against the side of the interruption position 58*b* by a spring force in the state in which the solenoid is demagnetized, and moves toward the side of the opening position 58*a* against the spring force when the solenoid is excited. However, a configuration may be made in which the spool is pressed against the opening position 58*a* in the demagnetized state and the spool moves toward the side of the interruption position 58*b* when the solenoid is excited.

The solenoid valve 58 is a valve having two positions set to allow switching to the opening position 58*a* and the interruption position 58*b*. When the solenoid valve 58 is switched to the opening position 58*a*, the pressure receiving chamber of the second directional control valve 55 on the boom lowering side is coupled to the boom lowering pressure reducing valve 57*d*. When the solenoid valve 58 is switched to the interruption position 58*b*, the pressure receiving chamber of the second directional control valve 55 on the boom lowering side is coupled to the hydraulic operating fluid tank 59. By adjusting the position of the spool by an excitation current to the solenoid of the solenoid valve 58, the ratio between the area of the opening that couples the pressure receiving chamber of the second directional control valve 55 to the boom lowering pressure reducing valve 57*d* and the area of the opening that couples the pressure receiving chamber to the hydraulic operating fluid tank 59 changes. The amount of pressure reduction of the boom lowering pilot pressure can be adjusted on the basis of this ratio of the opening area, and the corrected boom lowering pilot pressure for the second directional control valve 55 can be controlled. When the amount of pressure reduction of the boom lowering pilot pressure for the second directional control valve 55 by the solenoid valve 58 is larger (corrected boom lowering pilot pressure is lower), the amount of movement of the second directional control valve 55 in the boom lowering direction decreases even with the same boom lowering operation amount. Further, the supply amount of the pressurized fluid that flows from the second hydraulic pump 53 to the rod-side hydraulic chamber of the boom cylinder 15 decreases. As a result, the meter-in flow rate from the second hydraulic pump 53 to the rod-side hydraulic chamber of the boom cylinder 15 decreases even with the same boom lowering operation amount.

In the present embodiment, when the solenoid valve 58 is completely switched to the interruption position 58*b*, the boom lowering pilot pressure does not act on the second directional control valve 55, and the pressurized fluid ceases to be supplied from the second hydraulic pump 53 to the rod-side hydraulic chamber of the boom cylinder 15 even if boom lowering operation is executed. On the other hand, when the solenoid valve 58 is completely switched to the opening position 58*a*, the amount of pressure reduction of the boom lowering pilot pressure becomes the minimum. Due to this, the second directional control valve 55 operates according to the boom lowering operation amount at the same degree as the first directional control valve 54, and the pressurized fluid is supplied from the second hydraulic pump 53 to the rod-side hydraulic chamber of the boom cylinder 15.

—Sensor—

The operation amount of the boom operation lever 57*l* is measured by operation amount sensors S3 and S4. The operation amount sensor S3 measures a boom lowering operation amount Ad, and the operation amount sensor S3 measures a boom raising operation amount Au. The operation amount sensors S3 and S4 are both pressure sensors. The operation amount sensor S3 is disposed on the pilot hydraulic line 56*a* or 56*b* that connects the boom lowering pressure reducing valve 57*d* to the pressure receiving chamber of the first directional control valve 54 on the boom lowering side and the solenoid valve 58 (for example, at the output port of the boom lowering pressure reducing valve 57*d* or the immediately downstream thereof). The boom lowering operation amount Ad is measured by measuring the boom lowering pilot pressure by the operation amount sensor S3. The operation amount sensor S4 is disposed on the pilot hydraulic line 56*c* or 56*d* that connects the boom raising pressure reducing valve 57*u* to the first directional control valve 54 and the pressure receiving chamber of the second directional control valve 55 on the boom raising side (for example, at the output port of the boom raising pressure reducing valve 57*u* or the immediately downstream thereof). The boom raising operation amount Au is measured by measuring the boom raising pilot pressure by the operation amount sensor S4. It is also possible to make a configuration in which potentiometers or the like are used as the operation amount sensors S3 and S4 instead of pressure sensors and the angle of the boom operation lever 57*l* is measured to measure the boom lowering operation amount Ad and the boom raising operation amount Au.

A bottom pressure Pb (pressure of the bottom-side hydraulic chamber) of the boom cylinder 15 is measured by a bottom pressure sensor S1. The bottom pressure sensor S1 is a pressure sensor disposed on a hydraulic line that connects the bottom-side hydraulic chamber of the boom cylinder 15 to the first directional control valve 54 and the second directional control valve 55 (for example, at the input-output port of the bottom-side hydraulic chamber or the vicinity thereof).

Although being not necessarily required in the present embodiment, a rod pressure Pr (pressure of the rod-side hydraulic chamber) of the boom cylinder 15 is measured by a rod pressure sensor S2. The rod pressure sensor S2 is a pressure sensor disposed on a hydraulic line that connects the rod-side hydraulic chamber of the boom cylinder 15 to the first directional control valve 54 and the second directional control valve 55 (for example, at the input-output port of the rod-side hydraulic chamber or the vicinity thereof).

Measurement values of the above bottom pressure sensor S1, the rod pressure sensor S2, and the operation amount sensors S3 and S4 are input to the controller 60.

—Controller—

Operation of the solenoid valve 58 is controlled by the controller 60 on the basis of the bottom pressure Pb of the boom cylinder 15 and the operation amount of the boom operation lever 57*l*. The controller 60 is an in-machine computer including a CPU, a memory, a timer, and the like and executes a program stored in the memory in advance by the CPU to execute various kinds of processing. In the present embodiment, the controller 60 is equipped with a characteristic function of, at the time of boom lowering operation, controlling the solenoid valve 58 on the basis of the bottom pressure measured by the bottom pressure sensor S1, the boom lowering operation amount measured by the operation amount sensor S3, and the elapsed time after boom raising operation. This function will be described next.

Figure 3:
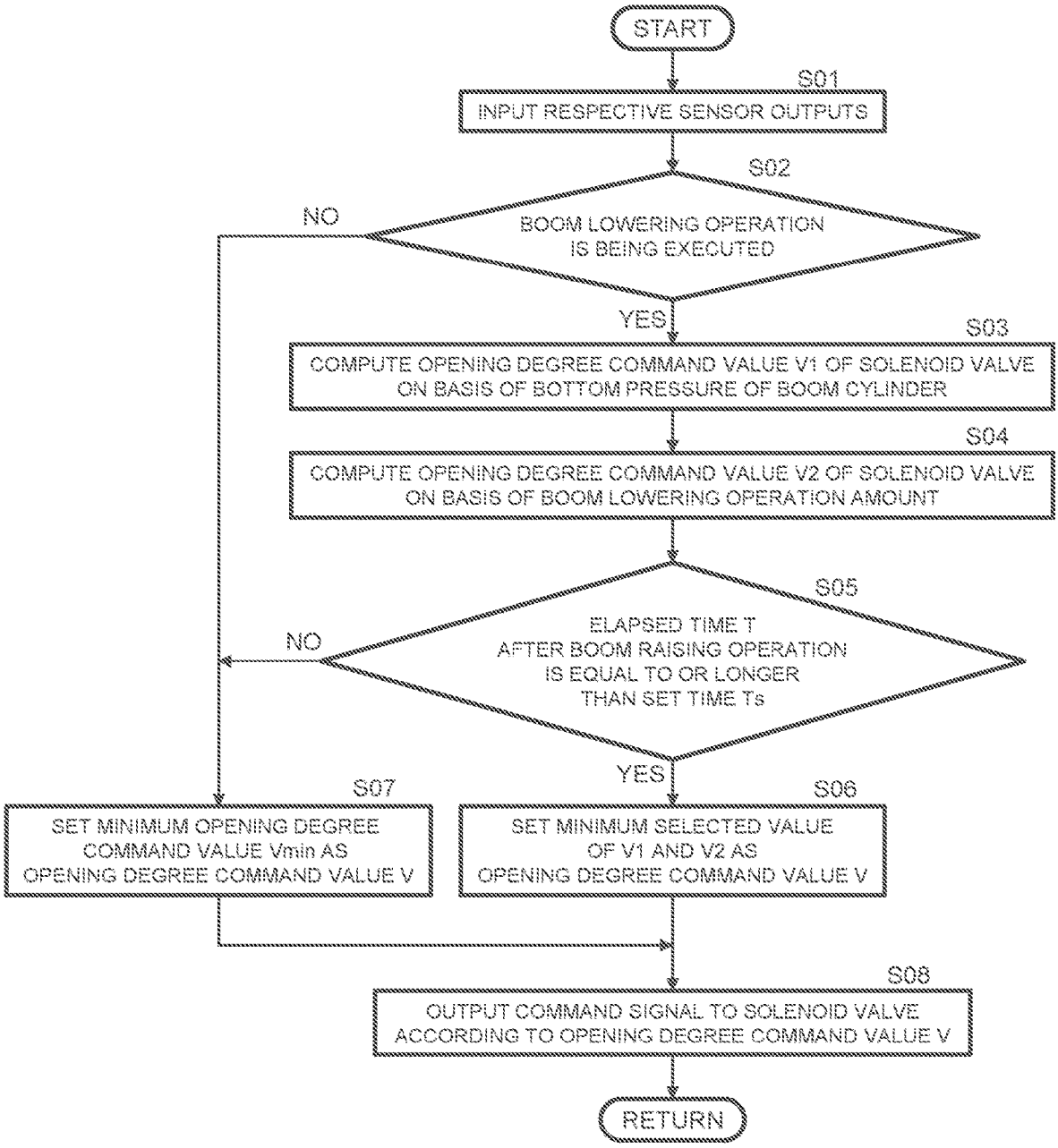
FIG. 3 is a flowchart representing the procedure of control of a solenoid valve by a controller mounted in the construction machine according to the one embodiment of the present invention.

FIG. 3 is a flowchart representing the procedure of control of the solenoid valve 58 by the controller 60. The controller 60 repeatedly executes the flow of FIG. 3 with a short cycle time (for example, 0.1 s) when being energized (for example, when a key switch is ON).

When the controller 60 starts the flow of this diagram, first, measurement values (output signals) of the bottom pressure sensor S1 and the operation amount sensors S3 and S4 are input to the controller 60 (step S01).

Subsequently, the controller 60 determines whether boom lowering operation is being executed (whether boom lowering operation amount Ad>0) according to the measurement value of the operation amount sensor S3 (step S02).

When boom lowering operation is being executed, the controller 60 shifts the procedure from the step S02 to a step S03. When boom lowering operation is not being executed, the controller 60 shifts the procedure from the step S02 to a step S07.

When boom lowering operation is being executed, the controller 60 computes a first opening degree command value V1 of the solenoid valve 58 on the basis of the bottom pressure Pb of the boom cylinder 15 measured by the bottom pressure sensor S1 (step S03). The first opening degree command value V1 is computed according to a control table set in such a manner that the communication area between the boom lowering pressure reducing valve 57*d* and the pressure receiving chamber of the second directional control valve 55 (opening area of the hydraulic line at the opening position 58*a*) decreases in association with increase in the bottom pressure Pb.

Next, the controller 60 computes a second opening degree command value V2 of the solenoid valve 58 on the basis of the boom lowering operation amount Ad measured by the operation amount sensor S3 (step S04). The order of the steps S03 and S04 may be reversed or be simultaneous. The second opening degree command value V2 is computed according to a control table set in such a manner that the communication area between the boom lowering pressure reducing valve 57*d* and the pressure receiving chamber of the second directional control valve 55 (opening area of the hydraulic line at the opening position 58*a*) increases in association with increase in the boom lowering operation amount Ad.

Subsequently, the controller 60 computes an elapsed time T after the most recent boom raising operation on the basis of the measurement value of the operation amount sensor S4 and determines whether the elapsed time T is equal to or longer than a set time Ts set in advance (step S05). The elapsed time T is, for example, the time from the clock time when the boom raising operation amount Au (>0) input most recently has become 0 to the current clock time. The clock time when the boom raising operation amount has reached a predetermined pilot pressure may be deemed as the beginning of the elapsed time T. When the elapsed time T is equal to or longer than the set time Ts, the controller 60 shifts the procedure from the step S05 to the step S06. When the elapsed time T is shorter than the set time Ts, the controller 60 shifts the procedure from the step S05 to the step S07.

When the elapsed time T after the boom raising operation is equal to or longer than the set time Ts, the controller 60 decides the minimum selected value (smaller value) of the first opening degree command value V1 and the second opening degree command value V2 as a final opening degree command value V (step S06).

When the elapsed time T after the boom raising operation is shorter than the set time Ts, the controller 60 decides a minimum opening degree command value Vmin as the final opening degree command value V (step S07). This is the same also when it is determined that boom lowering operation is not being executed in the step S02. The minimum opening degree command value Vmin is a value that minimizes the communication area between the boom lowering pressure reducing valve 57*d* and the pressure receiving chamber of the second directional control valve 55 (opening area of the hydraulic line at the opening position 58*a*). The minimum value of the communication area (opening area of the hydraulic line at the opening position 58*a*) is 0, for example. In this case, interruption is caused between the pressure receiving chamber of the second directional control valve 55 on the boom lowering side and the boom lowering pressure reducing valve 57*d*, and this pressure receiving chamber is connected to only the hydraulic operating fluid tank 59.

Upon deciding the opening degree command value V in the step S06 or S07, the controller 60 generates a command signal (current or voltage) according to the decided opening degree command value V and outputs the generated command signal to the solenoid valve 58 (applies the command signal to the solenoid) to return the procedure to the step S01 (step S08).

By controlling the solenoid valve 58 as above, motion of the second directional control valve 55 at the time of boom lowering operation is limited depending on the condition. When the motion of the second directional control valve 55 is limited, the meter-in flow rate from the second hydraulic pump 53 to the bottom-side hydraulic chamber of the boom cylinder 15 decreases even with the same boom lowering operation amount Ad.

Figure 4:
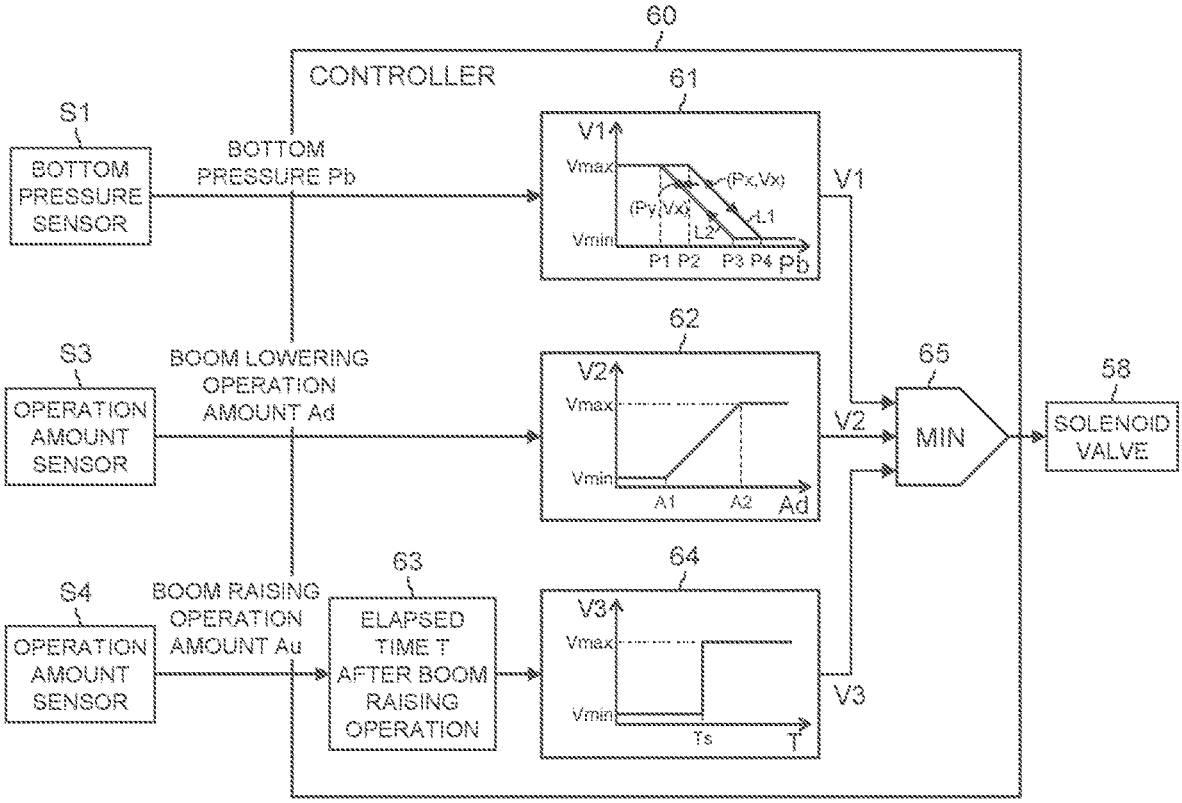
FIG. 4 is a diagram representing one example of functional blocks of the controller for executing the flow of FIG. 3.

FIG. 4 is a diagram representing one example of functional blocks of the controller 60 for executing the flow of FIG. 3. In the example illustrated in FIG. 4, the controller 60 is equipped with functions of executing processing of first opening degree command value computation 61, second opening degree command value computation 62, computation 63 of the elapsed time after boom raising operation, third opening degree command value computation 64, and opening degree command value decision 65.

The first opening degree command value computation 61 is processing of computing the first opening degree command value V1 on the basis of the bottom pressure Pb measured by the bottom pressure sensor S1 in accordance with a control line (control table) stored in the memory. As indicated in the block of the first opening degree command value computation 61, the control line is defined in such a manner that V1 decreases in association with increase in Pb in a Pb-V1 coordinate system in which Pb is plotted on the abscissa axis and V1 is plotted on the ordinate axis. The first opening degree command value V1 is equivalent to a value to make a command of the communication area between the boom lowering pressure reducing valve 57*d* and the pressure receiving chamber of the second directional control valve 55 on the boom lowering side, and the communication area increases when V1 is larger. V1 computed under the control line indicated in the block of the first opening degree command value computation 61 decreases in association with increase in the bottom pressure Pb.

At this time, in the present embodiment, a first control line L1 and a second control line L2 are included in the control line to which a reference is made in the first opening degree command value computation 61. The first control line L1 is a control line to which a reference is made at a time of rise in the bottom pressure Pb, and the second control line L2 is a control line to which a reference is made at a time of fall in the bottom pressure Pb. P1 to P4 indicated in the block of the first opening degree command value computation 61 are set values about Pb (P1<P2<P3<P4).

The first control line L1 is defined in such a manner that V1=Vmax (maximum opening degree command value) holds in a region of Pb<P2 and V1 monotonically decreases from Vmax to Vmin in association with increase in Pb in a region of P2≤Pb≤P4 and V1=Vmin (minimum opening degree command value) holds in a region of Pb>P4. The other second control line L2 is defined in such a manner that V1=Vmin holds in a region of Pb>P3 and V1 monotonically increases from Vmin to Vmax in association with decrease in Pb in a region of P1≤Pb≤P3 and V1=Vmax holds in a region of Pb<P1. As above, in the Pb-V1 coordinate system, the second control line L2 is offset in the decrease direction of Pb (−Pb direction) by a predetermined value ΔPb (=P2−P1=P4−P3) with respect to the first control line L1.

Detailed description will be made about the value of V1 computed in association with increase and decrease in Pb by the controller 60 under the control line. When Pb rises from a value equal to or larger than P2 (that is, a value with which V1 takes Vmax), the controller 60 decreases V1 along the first control line L1 (computes V1 corresponding to Pb on the first control line L1). Conversely, when Pb falls from a value equal to or larger than P3 (that is, a value with which V1 takes Vmin), the controller 60 increases V1 along the second control line L2 (computes V1 corresponding to Pb on the second control line L2). Therefore, for example, when Pb rises from P1 to P4 and thereafter decreases to P1, V1 decreases from Vmax to Vmin along the first control line L1 in association with the rise in Pb simply, and thereafter V1 increases from Vmin to Vmax along the second control line L2 in association with the fall in Pb.

In contrast, in the case in which the value of Pb turns to fall when having risen to Px (P2<Px<P4) from a value equal to or smaller than P2 before rising to P4, V1 is kept at Vx corresponding to Px on the first control line L1 only while Pb falls by ΔP. Then, when Pb falls from Py (=Px−ΔPb), V1 increases along the second control line L2.

The same applies also to the case in which the value of Pb turns to fall before falling to P1 from a value equal to or larger than P3. V1 keeps a value from the value on the second control line L2 to the value on the first control line L1 and thereafter decreases in association with rise in Pb along the first control line L1.

The second opening degree command value computation 62 is processing of computing the second opening degree command value V2 on the basis of the boom lowering operation amount Ad measured by the operation amount sensor S3 in accordance with a control line (control table) stored in the memory. As indicated in the block of the second opening degree command value computation 62, the control line is defined in such a manner that V2 increases in association with increase in Ad in an Ad-V2 coordinate system in which Ad is plotted on the abscissa axis and V2 is plotted on the ordinate axis. The second opening degree command value V2 is also equivalent to a value to make a command of the communication area between the boom lowering pressure reducing valve 57*d* and the pressure receiving chamber of the second directional control valve 55 on the boom lowering side, and the communication area increases when V2 is larger. V2 computed under the control line indicated in the block of the second opening degree command value computation 62 increases in association with increase in Ad.

A1 and A2 indicated in the block of the second opening degree command value computation 62 are set values about Ad (0<A1<A2). The control line to which a reference is made in the second opening degree command value computation 62 is defined in such a manner that V2=Vmin holds in a region of Ad<A1 and V2 monotonically increases from Vmin to Vmax in association with increase in Ad in a region of A1≤Ad≤A2 and V2=Vmax holds in a region of Ad>A2. Differently from the control line to which a reference is made in the first opening degree command value computation 61, the control line to which a reference is made in the second opening degree command value computation 62 is a single line, and a value on the control line is always computed as V2 with respect to Ad.

The computation 63 of the elapsed time after boom raising operation is processing of computing the elapsed time T from stop of the most recent boom raising operation to the current time on the basis of the boom raising operation amount Au measured by the operation amount sensor S4 and the measured clock time of a timer. The beginning of the elapsed time T is the clock time when the most recent boom raising operation amount Au (>0) has become 0. The clock time when the boom raising operation amount Au has become 0 can be identified from log data of the boom raising operation amount Au stored in the memory, for example, and the elapsed time T after boom raising operation is computed through taking the difference between this identified clock time and the current clock time.

The third opening degree command value computation 64 is processing of computing a third opening degree command value V3 of the solenoid valve 58 on the basis of the elapsed time T after boom raising operation. In the processing of the third opening degree command value computation 64, when the elapsed time T is shorter than the set time Ts, the third opening degree command value V3 of the solenoid valve 58 is computed to cause the communication area between the boom lowering pressure reducing valve 57*d* and the pressure receiving chamber of the second directional control valve 55 on the boom lowering side to become the minimum value (V3=Vmin). Further, when the elapsed time T is equal to or longer than the set time Ts, the third opening degree command value V3 of the solenoid valve 58 is computed to cause the communication area between the boom lowering pressure reducing valve 57*d* and the pressure receiving chamber of the second directional control valve 55 on the boom lowering side to become the maximum value (V3=Vmax).

The opening degree command value decision 65 is processing of deciding the minimum selected value of the first opening degree command value V1, the second opening degree command value V2, and the third opening degree command value V3 as the opening degree command value V and generating the command signal for the solenoid valve 58 on the basis of the decided opening degree command value V to output the command signal to the solenoid valve 58. The third opening degree command value V3 is the minimum opening degree command value Vmin when the elapsed time T after boom raising operation is shorter than the set time Ts. Thus, if T<Ts holds, inevitably V=Vmin holds. Moreover, V3=Vmax holds when the elapsed time T after boom raising operation is equal to or longer than the set time Ts. Thus, if T≥Ts holds, inevitably the minimum selected value of V1 and V2 becomes V.

By controlling the solenoid valve 58 by the processing exemplified above, the limitation amount of the meter-in flow rate to the bottom-side hydraulic chamber of the boom cylinder 15 at the time of boom lowering operation is favorably controlled as described previously with FIG. 3.

In the present embodiment, when the boom lowering operation amount Ad is small or the bottom pressure Pb is high, the motion of the second directional control valve 55 is limited (motion limitation is strengthened) and the meter-in flow rate to the rod-side hydraulic chamber of the boom cylinder 15 decreases. When the boom lowering operation amount Ad is small or the bottom pressure Pb is high, it is presumed that boom lowering motion is being executed in the state in which the bucket 14 is suspended in the air, and energy loss can be suppressed by suppressing the unnecessary meter-in flow rate for boom lowering in such a scene.

Further, when the boom lowering operation amount Ad is large and the bottom pressure Pb is low, the motion limitation of the second directional control valve 55 is released (motion limitation is weakened) and the meter-in flow rate to the rod-side hydraulic chamber of the boom cylinder 15 increases. When the boom lowering operation amount Ad is large and the bottom pressure Pb is low, a situation in which the bucket 14 is strongly pushed into a ground surface as in jack-up motion or the like is presumed, and the meter-in flow rate for boom lowering can be ensured in a scene of such high-load work.

Moreover, during the period until the elapsed time T after the most recent boom raising operation reaches the set time Ts, the motion of the second directional control valve 55 is prohibited (motion limitation becomes the maximum), and the meter-in flow rate to the rod-side hydraulic chamber of the boom cylinder 15 does not immediately increase even when boom lowering operation is executed. For example, in the case in which boom raising operation and boom lowering operation are alternately repeated with a short cycle as in bumping work, the bottom pressure Pb of the boom cylinder 15 often greatly varies, for example, when the motion is switched from boom raising to boom lowering. If the control condition of the solenoid valve 58 is incidentally satisfied in such a scene, there is a possibility that the solenoid valve 58 is actuated in an undesired scene, and the operability deteriorates. However, the solenoid valve 58 is not actuated until the set time Ts elapses from boom raising operation, and therefore the deterioration of the operability can be suppressed.

Effects (1) As described above, according to the present embodiment, in a scene in which boom lowering motion of a low load like one executed in the state in which the bucket 14 is suspended in the air is presumed, energy loss can be suppressed by suppressing the meter-in flow rate for boom lowering. Further, in a scene in which boom lowering motion of a high load in which the bucket 14 is strongly pressed against a ground surface as in jack-up motion or the like is presumed, the requisite output power can be ensured through increasing the meter-in flow rate for boom lowering. Moreover, in a scene in which the solenoid valve 58 is possibly actuated in an undesired form in the case in which boom raising operation and boom lowering operation are repeated as in bumping work or the like, the actuation of the solenoid valve 58 is inhibited until the set time Ts elapses from boom raising operation. This can suppress the occurrence of a high meter-in flow rate at the time of boom lowering and suppress the deterioration of the operability.

As above, according to the present embodiment, the motion speed of the boom can be caused to correspond with the required speed, and both reduction in energy loss and improvement in the operability can be achieved.

(2) There is a moment at which the bottom pressure Pb increases or decreases in operation of the front work implement 10, such as when a transition is made from the state in which the bucket 14 is suspended in the air to jack-up motion in boom lowering motion or when the boom cylinder 15 is rapidly contracted by sudden operation, for example. When the first opening degree command value V1 is increased or decreased in response to such instantaneous increase or decrease in the bottom pressure Pb, there is a possibility that the solenoid valve 58 is sensitively actuated and the operability is affected.

In contrast, in the present embodiment, the first control line L1 and the second control line L2 are prepared, the first opening degree command value V1 is computed under the first control line L1 at the time of rise in Pb, and the first opening degree command value V1 is computed under the second control line L2 at the time of fall in Pb. The first control line L1 and the second control line L2 are offset by ΔPb in the Pb-axis direction in the Pb-V1 coordinate system. Thus, when the value of Pb turns from increase to decrease (or from decrease to increase), the first opening degree command value V1 does not change until the change in Pb exceeds the certain amount (ΔPb). Therefore, it is possible to suppress the sensitive motion of the solenoid valve 58 in the scene in which the bottom pressure Pb increases or decreases as described above.

MODIFICATION EXAMPLES

Although the one embodiment of the present invention has been described above, embodiments of the present invention are not limited to the above mode and can be variously changed within such a range as not to depart from the gist of the present invention. Several modification examples will be exemplified below.

For example, the example in which the first opening degree command value V1 is computed according to only the bottom pressure Pb of the boom cylinder 15 has been described. Regarding this point, it is also possible to make a configuration in which the controller 60 computes the difference between the rod pressure Pr measured by the rod pressure sensor S2 and the bottom pressure Pb and computes the first opening degree command value V1 on the basis of this difference.

Further, the operation lever device 57 including the boom operation lever 57*l* mechanically linked to the boom lowering pressure reducing valve 57*d* and the boom raising pressure reducing valve 57*u* has been described. However, it is also possible to employ an electrical lever device as the operation lever device 57. In this case, a configuration is made in which the boom lowering pressure reducing valve 57*d* and the boom raising pressure reducing valve 57*u* are made into an electromagnetically driven type and the boom lowering pressure reducing valve 57*d* and the boom raising pressure reducing valve 57*u* are operated according to the command signal output from the controller 60 in response to an operation signal of the electrical lever device. Also when the electrical lever device is employed as the operation lever device 57, the operation amount of the boom operation lever 57*l* can be sensed by a potentiometer or the like, and the present invention can be applied.

Moreover, description has been made by taking as an example the configuration including one first hydraulic pump 52 and one second hydraulic pump 53. However, it is also possible to make a configuration in which a plurality of pumps are disposed as at least one of the first hydraulic pump 52 and the second hydraulic pump 53.

DESCRIPTION OF REFERENCE CHARACTERS

1: Hydraulic excavator (construction machine)
4: Machine body
10: Front work implement
15: Boom cylinder
51: Prime mover
52: First hydraulic pump
53: Second hydraulic pump
54: First directional control valve
55: Second directional control valve
56: Pilot pump
56*b*: Pilot hydraulic line
57*d*: Boom lowering pressure reducing valve
57*l*: Boom operation lever

57*u*: Boom raising pressure reducing valve
58: Solenoid valve
60: Controller
Ad: Boom lowering operation amount (operation amount)
Au: Boom raising operation amount (operation amount)
L1: First control line
L2: Second control line
Pb: Bottom pressure
Pr: Rod pressure
S1: Bottom pressure sensor
S2: Rod pressure sensor
S3, S4: Operation amount sensor
T: Elapsed time
Ts: Set time
V: Opening degree command value
V1: First opening degree command value
V2: Second opening degree command value
V3: Third opening degree command value
Vmax: Maximum opening degree command value
Vmin: Minimum opening degree command value

The invention claimed is:

1. A construction machine including a machine body, a front work implement joined to the machine body, a boom cylinder that vertically drives the front work implement, a prime mover, a first hydraulic pump driven by the prime mover, a second hydraulic pump driven by the prime mover, a first directional control valve that controls a pressurized fluid that flows from the first hydraulic pump to the boom cylinder, a second directional control valve that controls a pressurized fluid that flows from the second hydraulic pump to the boom cylinder, a pilot pump that delivers a pilot fluid that drives the first directional control valve and the second directional control valve, a boom lowering pressure reducing valve that outputs a boom lowering pilot pressure that drives the first directional control valve and the second directional control valve in a boom lowering direction with use of the pilot fluid as a source pressure, a boom raising pressure reducing valve that outputs a boom raising pilot pressure that drives the first directional control valve and the second directional control valve in a boom raising direction with use of the pilot fluid as a source pressure, and a boom operation lever to operate the boom lowering pressure reducing valve and the boom raising pressure reducing valve, the construction machine comprising:

a bottom pressure sensor that measures a bottom pressure of the boom cylinder;

an operation amount sensor that measures an operation amount of the boom operation lever;

a solenoid valve that is disposed on a pilot hydraulic line that couples the boom lowering pressure reducing valve and a pressure receiving chamber of the second directional control valve and reduces the boom lowering pilot pressure for the second directional control valve; and a controller that controls the solenoid valve on a basis of the bottom pressure measured by the bottom pressure sensor and the operation amount measured by the operation amount sensor, wherein the controller is configured to compute a first opening degree command value in such a manner that a communication area between the boom lowering pressure reducing valve and the pressure receiving chamber of the second directional control valve decreases in association with increase in the bottom pressure on a basis of the bottom pressure measured by the bottom pressure sensor, compute a second opening degree command value in such a manner that the communication area increases in association with increase in a boom lowering operation amount on a basis of the boom lowering operation amount measured by the operation amount sensor, decide a minimum opening degree command value that minimizes the communication area as an opening degree command value of the solenoid valve when an elapsed time after boom raising operation is shorter than a set time and decide a minimum selected value of the first opening degree command value and the second opening degree command value as the opening degree command value of the solenoid valve when the elapsed time is equal to or longer than the set time, on a basis of the elapsed time after boom raising operation, and output a command signal according to the decided opening degree command value to the solenoid valve.

2. The construction machine according to claim 1, wherein the controller is configured to store a first control line and a second control line that are defined in such a manner that the first opening degree command value decreases in association with increase in the bottom pressure and are offset in a direction of an abscissa axis in a coordinate system in which the bottom pressure is plotted on the abscissa axis and the first opening degree command value is plotted on an ordinate axis, and compute the first opening degree command value with reference to the first control line at a time of rise in the bottom pressure and compute the first opening degree command value with reference to the second control line at a time of fall in the bottom pressure.

3. The construction machine according to claim 1, further comprising:

a rod pressure sensor that measures a rod pressure of the boom cylinder, wherein the controller is configured to compute a difference between the bottom pressure measured by the bottom pressure sensor and the rod pressure measured by the rod pressure sensor and compute the first opening degree command value on a basis of the difference.

* * * * *